US011522296B2

(12) United States Patent
Chen et al.

(10) Patent No.: US 11,522,296 B2
(45) Date of Patent: Dec. 6, 2022

(54) ANTENNA AND MOBILE TERMINAL

(71) Applicant: HUAWEI TECHNOLOGIES CO., LTD., Shenzhen (CN)

(72) Inventors: Fengwen Chen, Dongguan (CN); Jiao Liang, Dongguan (CN); Antti Karilainen, Helsinki (FI); Guozhong Ma, Shenzhen (CN); Dongxing Tu, Shenzhen (CN); Joonas Krogerus, Helsinki (FI); Zlatoljub Milosavljevic, Helsinki (FI); Konstantin Sokolov, Helsinki (FI)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 22 days.

(21) Appl. No.: 17/272,710

(22) PCT Filed: Sep. 7, 2018

(86) PCT No.: PCT/CN2018/104694
§ 371 (c)(1),
(2) Date: Mar. 2, 2021

(87) PCT Pub. No.: WO2020/047867
PCT Pub. Date: Mar. 12, 2020

(65) Prior Publication Data

US 2021/0376477 A1 Dec. 2, 2021

(51) Int. Cl.
*H01Q 1/24* (2006.01)
*H01Q 13/18* (2006.01)
(Continued)

(52) U.S. Cl.
CPC ..... *H01Q 13/18* (2013.01); *H01Q 1/243* (2013.01); *H01Q 1/42* (2013.01); *H01Q 7/005* (2013.01)

(58) Field of Classification Search
CPC ..... H01Q 13/18; H01Q 1/243; H01Q 1/42; H01Q 7/005
See application file for complete search history.

(56) References Cited

U.S. PATENT DOCUMENTS

2012/0231750 A1 9/2012 Jin et al.
2013/0293424 A1 11/2013 Zhu et al.
(Continued)

FOREIGN PATENT DOCUMENTS

CN 201294266 Y 8/2009
CN 104681977 A 6/2015
(Continued)

*Primary Examiner* — Graham P Smith
(74) *Attorney, Agent, or Firm* — Rimon PC

(57) ABSTRACT

A mobile terminal includes a display, a side frame, a back cover and an antenna. The antenna includes a conductive support and a feeding part. The conductive support includes a first portion and a third portion disposed opposite to each other, and a second portion and a fourth portion disposed opposite to each other. The four portions are made of conductive materials and jointly enclose a cavity. The second portion is disposed on an inner side of the display. The third portion is a part of the side frame. The fourth portion is located on an outer side or an inner side of the back cover, or is a part of the back cover. A gap is disposed between the fourth portion and the first portion, or is disposed in the fourth portion, and the antenna can radiate electromagnetic wave signal through the cavity and the gap.

20 Claims, 13 Drawing Sheets

(51) Int. Cl.
*H01Q 1/42* (2006.01)
*H01Q 7/00* (2006.01)

(56) References Cited

U.S. PATENT DOCUMENTS

| | | | |
|---|---|---|---|
| 2017/0012344 | A1 | 1/2017 | Wu et al. |
| 2017/0288300 | A1 | 10/2017 | Slater et al. |
| 2018/0090817 | A1 | 3/2018 | Rajagopalan et al. |

FOREIGN PATENT DOCUMENTS

| | | | |
|---|---|---|---|
| CN | 204905439 | U | 12/2015 |
| CN | 107819193 | A | 3/2018 |

ANTENNA AND MOBILE TERMINAL

CROSS-REFERENCE TO RELATED APPLICATIONS

This application is a national stage of International Application No. PCT/CN2018/104694, filed on 7 Sep. 2018, which is hereby incorporated by reference in its entirety.

TECHNICAL FIELD

This application relates to the field of mobile terminal technologies, and in particular, to an antenna designed for a mobile terminal.

BACKGROUND

With the development of mobile terminals, terminal products are becoming smaller in sizes and loaded with more and more functions, while the internal space of the terminal products remains limited. Using a mobile phone as an example, as its screen becomes increasingly larger, the space for housing an antenna becomes increasingly smaller. 4G standards provide specified requirements for MIMO antennas. However, as 5G standards are gradually released, new frequency bands N77 (3.3 GHz to 4.2 GHz), N78 (3.3 GHz to 3.8 GHz), and N79 (4.4 GHz to 5 GHz) are added to the 5G standards. MIMO antennas and new 5G frequency bands impose more antenna layout requirements, requiring better utilization of antenna layout space in mobile phones.

Therefore, how to utilize limited space in a mobile terminal to provide an antenna that has a low space clearance requirement and can still achieve better radiation functionalities is an urgent problem to be solved in the industry.

SUMMARY

An embodiment of this application provides an antenna that can be installed in limited space inside a side frame of a mobile terminal, has a low working space clearance requirement, and can achieve better antenna radiation functionalities.

According to one aspect, an embodiment of this application provides an antenna, applied to a mobile terminal, where the mobile terminal includes a display, a side frame, and a back cover. The side frame is connected between the display and the back cover, and the antenna includes a conductive support and a feeding part. The conductive support includes a first portion, a second portion, a third portion, and a fourth portion that are made of conductive materials and jointly form an enclosed cavity. The first portion and the third portion are disposed opposite to each other and are respectively connected to a head end and a tail end of the second portion. The fourth portion and the second portion are disposed opposite to each other. The second portion is disposed on an inner side of the display, the third portion is a part of the side frame, and the fourth portion is located on an outer side of the back cover, or is located on an inner side of the back cover, or is a part of the back cover. The conductive support is provided with a gap. The gap is configured to radiate an electromagnetic wave signal. The gap is formed between the fourth portion and the first portion, or is formed between the fourth portion and the third portion, or is disposed in the fourth portion. The feeding part is electrically connected to the conductive support, and is configured to feed an electromagnetic wave signal, and excite the conductive support to generate a current and to form a strong electric field at the gap. A distributed capacitor is formed at the gap, and a current loop inductor is formed at the conductive support, together producing a resonance mode, so as to radiate an electromagnetic wave signal to the outside of the mobile terminal.

The antenna provided in this application forms the cavity by using the conductive support, and the cavity is in communication with an external signal through the gap. "In communication with an external signal" means that an electromagnetic wave signal may be radiated to the outside through the gap. In other words, an electromagnetic wave radiation path is formed between the cavity and the outside of the terminal through the gap. The feeding part feeds the conductive support, to excite the conductive support to generate a current flow, to form a strong electric field at the gap and radiate an electromagnetic wave signal from the gap. The feeding part and the conductive support form a current loop. The current loop forms a magnetic pole, and in a form of near-field coupling, the conductive support is excited to generate a current opposite to the direction of the current loop. In addition, a strong electric field is formed at the gap, and a distributed capacitor is formed through the gap, which is equivalent to capacitive loading. The distributed capacitor formed by the gap and an inductor of the current loop formed by the conductive support become what is equivalent to an LC resonant cavity. When the LC circuit is in a resonant mode, the antenna radiates electromagnetic wave signals. The cavity enclosed by the conductive support has a low clearance requirement on working space, so that the antenna can be installed in a location having a poor clearance condition, for example, inside a mobile terminal in the middle area between the top and the bottom of the mobile terminal, thereby expanding the antenna layout space and making the antenna layout space in the mobile terminal more flexible.

In a specific implementation, the mobile terminal includes a middle frame, the middle frame is configured to mount the display. The second portion is a part of the middle frame, and the cavity is enclosed by the middle frame, the side frame, and the fourth portion. This implementation provides a mobile terminal of a front-mounted stacked architecture, where a display is mounted on a front side of a middle frame, a circuit board and a battery are installed between the middle frame and a back cover, and the antenna is enclosed by the battery, the middle frame, the side frame, and the back cover.

In a specific implementation, the back cover is made of a non-conductive material, such as glass or plastic, and the fourth portion is a conductive layer disposed on an inner surface of the back cover. The fourth portion is a conductive layer formed on the inner surface of the back cover using a cold injection technique, a laser direct molding technique, or a printing direct molding technique, and the fourth portion may alternatively be an FPC flexible board or a conductive film attached to the inner surface of the back cover. Specifically, a metal film may be attached to the inner surface of the back cover, and the size and shape of the metal film may be adjusted as required, to adjust a resonance frequency of the antenna.

In a specific implementation, a notch is formed at a joint between the fourth portion and the third portion, to lower the resonance frequency of the antenna. The notch includes a first notch and a second notch. The fourth portion includes a connecting part connected to the third portion and a main part away from the third portion, the first notch and the second notch are symmetrically distributed on two sides of the connecting part, and the fourth portion is T-shaped. A gap configured to radiate electromagnetic waves is formed between the main part and the first portion. The main part may be a rectangle.

In a specific implementation, the back cover is made of a non-conductive material, and the fourth portion is a functional layer attached to an outer surface of the back cover. The functional layer may be a display used for display or a touch layer used for touching or the like. For example, a bar-shaped display is disposed, as a functional layer, at an edge position that is near the side frame and that is on a surface of the back cover. The functional layer, the side frame, the middle frame, and the first portion jointly form the resonant cavity (namely, the foregoing cavity) of the antenna. Certainly, the functional layer may alternatively be a touch layer, and an interface of the mobile terminal is controlled by touch operations performed by a human hand on the touch layer. It may be configured as a touch key for volume adjustment, a touch surface for brightness adjustment, a touch key for starting or exiting a program, or the like.

The back cover in the foregoing two implementations is made of a non-conductive material. A conductive layer or a functional layer having a conductive function is disposed on the inner surface or the outer surface of the back cover, to implement arrangement of the fourth portion of the conductive support. However, this application is not limited to the foregoing two implementations. In another implementation, the back cover includes a conductive area and a non-conductive area that are adjacent to each other, the fourth portion is formed in the conductive area, and the electromagnetic wave signal is radiated out through the non-conductive area. In this implementation, the back cover is formed in an integrated molding manner to form the conductive area and the non-conductive area. The conductive area is disposed at an edge position of the back cover, and is disposed between the non-conductive area and the side frame.

Configurations of the feeding part in this application include different embodiments in which the feeding part is disposed inside and outside the cavity.

In an implementation, the feeding part extends into the cavity, and the feeding part and the conductive support jointly form a current loop in the cavity.

In a specific implementation, the feeding part passes through the second portion to extend into the cavity, and the feeding part is fixedly connected to the second portion. The feeding part may be a coaxial line. A through hole is disposed in the second portion, so that the coaxial line passes through the through and extends into the cavity. An outer conductor of the coaxial line and the second portion may be fixed by welding.

One end of the feeding part is connected to the second portion, and the other end of the feeding part is connected to the third portion, so that the feeding part, at least a part of the second portion, and at least a part of the third portion jointly form the current loop. The feeding part may be in a bent shape such as an L shape or a C shape.

One end of the feeding part is connected to the second portion, and the other end of the feeding part is connected to the fourth portion, so that the feeding part, at least a part of the fourth portion, the third portion, and at least a part of the second portion jointly form the current loop. The feeding part may be in a shape of a straight line.

In an implementation, the feeding part is located outside the cavity, the feeding part is fixedly connected to the side frame of the mobile terminal, and the feeding part may be disposed side by side with the fourth portion, that is, a vertical projection of the feeding part onto a plane on which the fourth portion is located is on a side of the first portion. The feeding part may be adjacent to the fourth portion, or may be spaced apart from the fourth portion, that is, the vertical projection of the feeding part onto the plane on which the fourth portion is located does not overlap with the fourth portion. There may be an area of at least partial overlapping between the feeding part and the fourth portion, where the feeding part is located on a side that is of the fourth portion and that faces the second portion, and at least a part of the feeding part is covered by the fourth portion. The conductive support is excited through feeding of the feeding part to form the current loop.

The feeding part includes a flexible circuit board, a feeding circuit is disposed on the flexible circuit board, and the flexible circuit board is fixedly connected to the side frame, so that the feeding circuit is electrically connected to the conductive support. In another implementation, the feeding part may alternatively be a coaxial line or another feeding form.

Specifically, an inner surface of the side frame is connected to a fixed boss, and the flexible circuit board is fixedly connected to the fixed boss.

In an implementation, the mobile terminal includes a middle frame. The middle frame is located on the inner side of the back cover. The fourth portion is a part of the middle frame, and the cavity is enclosed by the second portion, the side frame, and the middle frame. A through hole is disposed in the middle frame to form the gap. This implementation provides a mobile terminal of a back-mounted stacked architecture. Components such as a battery and a circuit board are installed between a middle frame and a display, and a back cover covers the middle frame. Usually, the middle frame is made of a conductive material. In this implementation, a through hole is disposed in the middle frame as a gap used by the antenna to radiate an electromagnetic wave signal. In this implementation, a gap in a non-conductive material may positioned on the back cover and may be in a middle area of the fourth portion, or may be in a position adjacent to the fourth portion and the first portion, or may be in a position adjacent to the fourth portion and the third portion. The first portion may be a plate-like structure integrated with the middle frame, for example, a metal wall, or may be a conductive layer structure attached to a side wall of the battery, for example, a metal film.

In an implementation, the cavity is filled with a medium to adjust or change a frequency of the antenna. The medium may be plastic of a PC material or an injection molding material used for nano-injection molding. A higher permittivity of the medium indicates a lower resonance frequency of the antenna. Certainly, the medium may alternatively be air. A relative permittivity range of the medium may be 1 to 4, which means a permittivity relative to a vacuum.

In an implementation, the antenna further includes a conductive member. The conductive member is disposed in the cavity and is electrically connected between the second portion and the fourth portion, and the conductive member forms an inductor path in the cavity, to adjust the resonance frequency of the antenna.

In an implementation, the conductive support is provided with a slot, and the slot is disposed in the first portion or the second portion, and is disposed corresponding to a central area of the cavity. The slot is configured to adjust the resonance frequency of the antenna.

In an implementation, the side frame includes a display part, the display part is a part of a display area of the display, and the part of the display area extends to a position of the side frame, and the third portion is a part of the display part. This implementation is applicable to a curved-screen mobile terminal, and the position of the side frame is a curved part of the display.

In an implementation, there are two or more conductive supports. The conductive supports are distributed on a same side of the mobile terminal. There is one feeding part, and the one feeding part simultaneously excites the two or more conductive supports. In this implementation, the feeding part is located between fourth portions of two adjacent conductive supports.

There may be two or more antennas, and the antennas are distributed between the side frame at a long side of the mobile terminal and the battery.

According to a second aspect, this application further provides a mobile terminal that includes a display, a side frame, and a back cover, where the side frame is connected between the display and the back cover, a battery is disposed inside the mobile terminal, the mobile terminal further includes the antenna according to any one of the foregoing implementations, and the antenna is located between the battery and the side frame.

The mobile terminal includes a pair of long sides and a pair of short sides, there are two or more antennas, the side frame includes a side frame at the long side and a side frame at the short side, and the antenna is distributed between the side frame at the long side and the battery.

DESCRIPTION OF EMBODIMENTS

The following describes the embodiments of the present invention with reference to the accompanying drawings.

Figure 1:
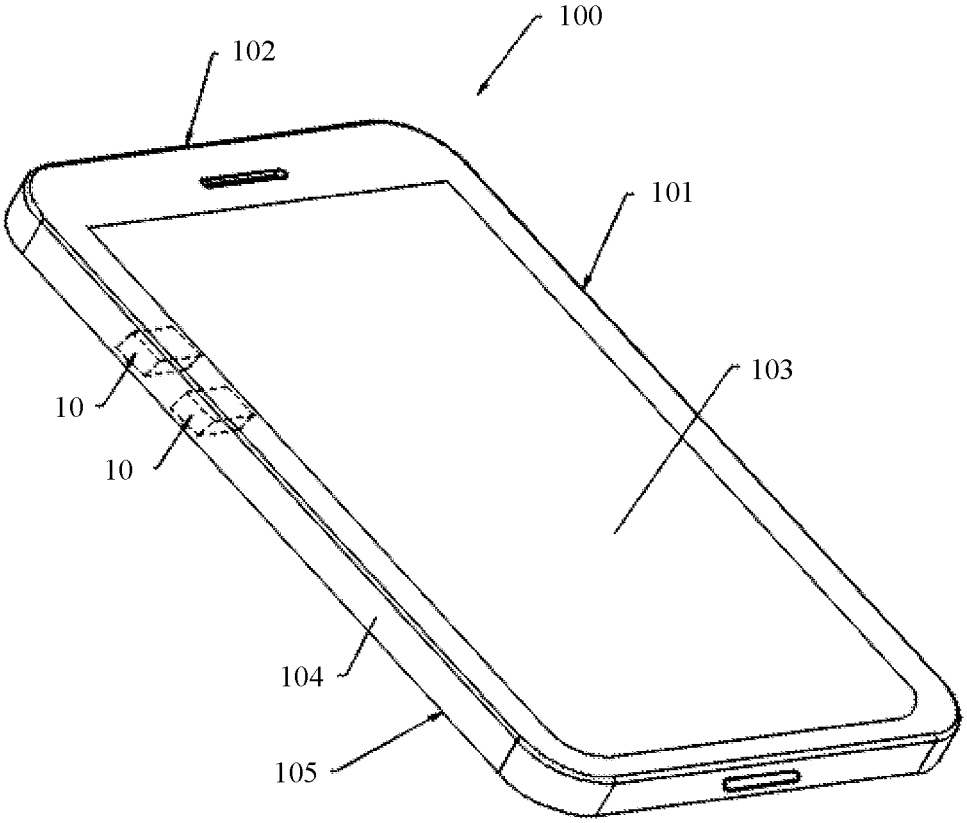
FIG. 1 is a schematic diagram of a mobile terminal according to an implementation of this application.
Figure 2:
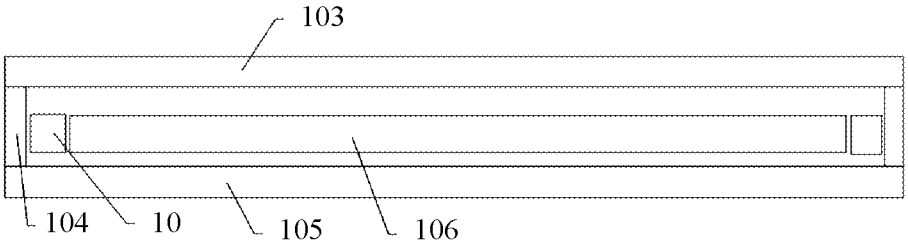
FIG. 2 is a schematic cross-sectional view of a mobile terminal according to an implementation of this application.

An embodiment of this application provides an antenna designed for a mobile terminal. In a specific implementation, the mobile terminal may be a mobile phone. As shown in FIG. 1, the mobile terminal 100 includes a pair of long sides 101 and a pair of short sides 102. When the mobile terminal 100 is normally used, the pair of short sides 102 are respectively the top and the bottom of the mobile terminal 100, and the top and the bottom of the mobile terminal 100 are optimal positions for deploying antennas and have a good clearance environment. However, antennas such as 4G, Wi-Fi, and GPS antennas already occupy these two optimal layout spaces: the top and bottom. With the development of 4G standards to 5G standards, new MIMO and 5G antennas cannot be disposed in the top and bottom spaces anymore. An antenna 10 provided in this application is disposed close to the long side 101 of the mobile terminal 100. Specifically, as shown in FIG. 1 and FIG. 2, the mobile terminal 100 includes a display 103, a side frame 104, and a back cover 105, the side frame 104 is connected between the display 103 and the back cover 105, and a battery 106 is disposed inside the mobile terminal 100, the battery 106 is disposed on an inner side of the back cover 105, and the antenna 10 provided in this application is disposed between the side frame 104 at the long side 101 and the battery 106. Two or more antennas 10 may be disposed in one mobile terminal 100, to implement different radio frequency receiving and transmitting functions.

Figure 3A:
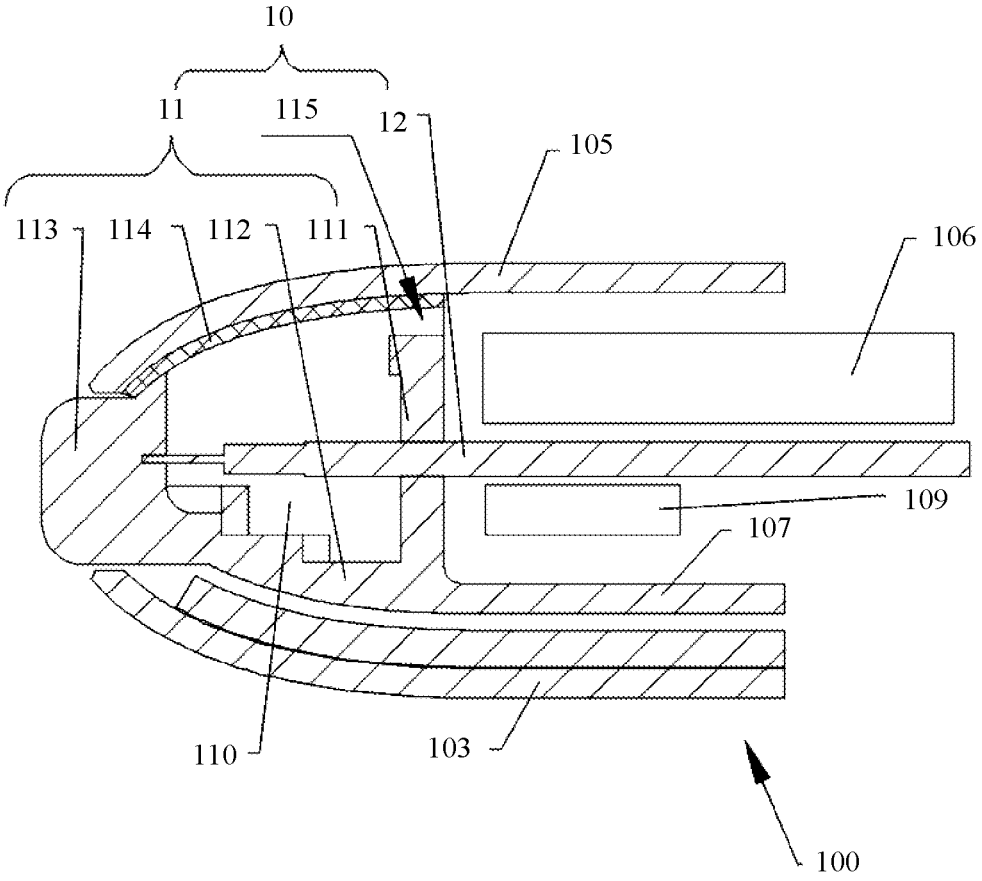
FIG. 3A is a schematic profile view of an antenna applied in a mobile terminal according to an implementation of this application.
Figure 3B:
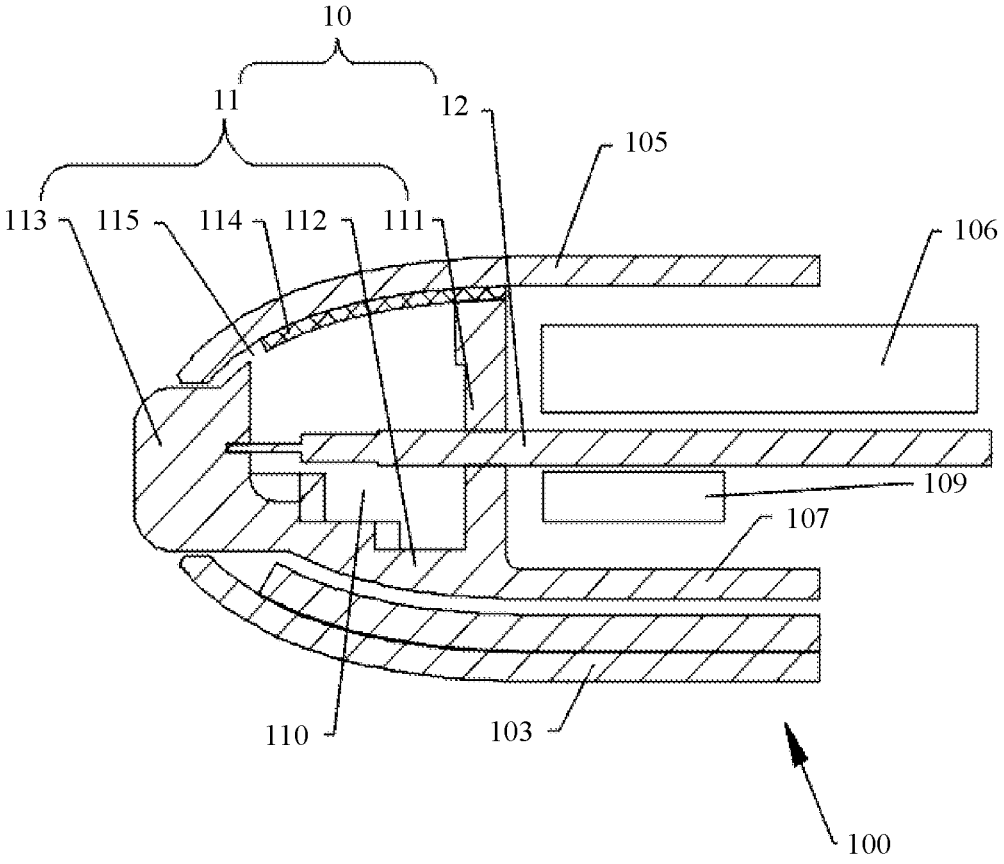
FIG. 3B is a schematic profile view of an antenna applied in a mobile terminal according to another implementation of this application.

As shown in FIG. 3A and FIG. 3B, an embodiment of this application provides an antenna 10 including a conductive support 11 and a feeding part 12. The conductive support 11 is disposed to form a resonant cavity, and the feeding part 12 feeds the conductive support 11, to radiate an electromagnetic wave signal. Specifically, the conductive support 11 includes a first portion 111, a second portion 112, a third portion 113, and a fourth portion 114 that are made of conductive materials and are jointly disposed to form a cavity 110 (namely, the resonant cavity). The first portion 111 and the third portion 113 are disposed opposite to each other and are respectively connected to a head end and a tail end of the second portion 112, and the fourth portion 114 and the second portion 112 are disposed opposite to each other. The second portion 112 is disposed on an inner side of a display 103 of a mobile terminal 100, the third portion 113 is a part of a side frame 104 of the mobile terminal 100, and the fourth portion 114 is located on an outer side of a back cover 105 of the mobile terminal 100, or is located on an inner side of a back cover 105, or is a part of a back cover 105. The conductive support 11 is provided with a gap 115, the gap 115 is configured to radiate an electromagnetic wave signal, and the gap 115 is formed between the fourth portion 114 and the first portion 111 (an embodiment shown in FIG.

Figure 12:
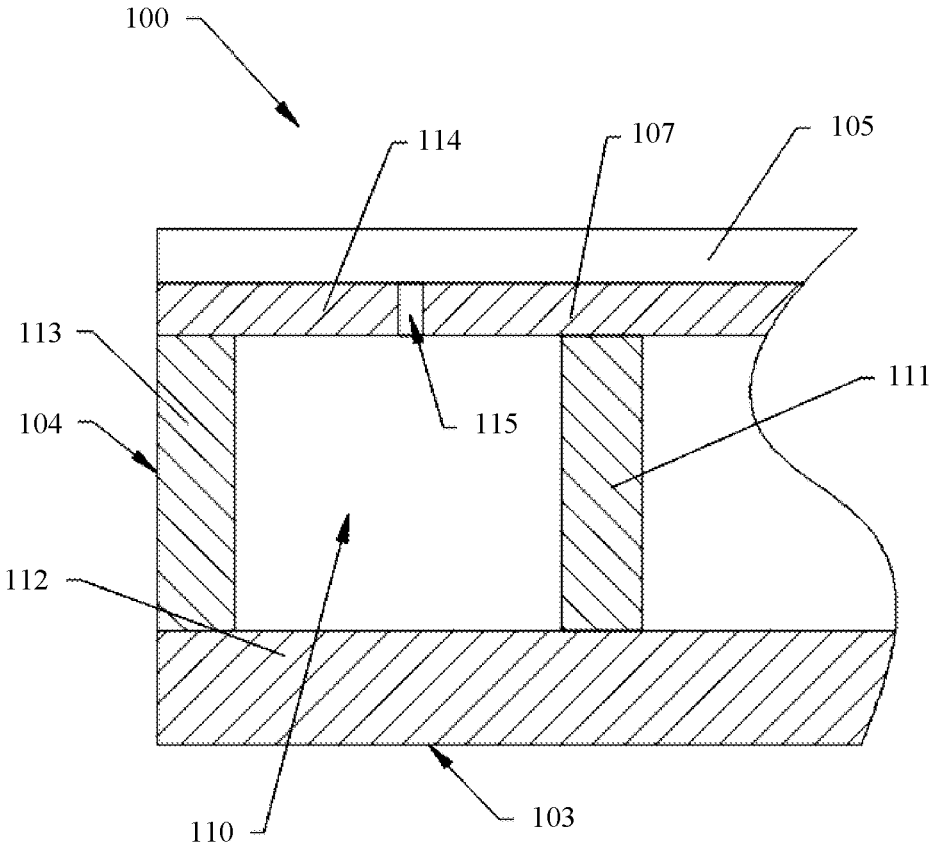
FIG. 12 is a schematic diagram of an antenna according to an implementation of this application, where only a structure of a conductive support is shown and a feeding part is not included.

3A), or is formed between the fourth portion 114 and the third portion 113 (an embodiment shown in FIG. 3B), or is disposed in the fourth portion 114 (an embodiment shown in FIG. 12). When the gap 115 is formed at a position between the fourth portion 114 and the first portion 111, a direction of electromagnetic wave radiation of the antenna 10 is toward a middle part of the mobile terminal. When the gap 115 is formed at a position between the fourth portion 114 and the third portion 113, a direction of electromagnetic wave radiation of the antenna 10 is toward an edge of the mobile terminal. When the gap 115 is disposed in the fourth portion 114, a direction of electromagnetic wave radiation of the antenna 10 is toward a position that is of a back cover and that corresponds to the fourth portion. The feeding part 12 is electrically connected to the conductive support 11, and is configured to feed an electromagnetic wave signal, and excite the conductive support 11 to generate a current, and to form a strong electric field at the gap 115, so as to radiate the electromagnetic wave signal to the outside of the mobile terminal 100.

In the antenna provided in this application, the cavity 110 is formed by using the conductive support 11, and the cavity 110 is in communication with an external signal through the gap 115. "In communication with an external signal" means that an electromagnetic wave signal may be radiated to the outside through the gap 115. In other words, an electromagnetic wave radiation path is formed between the cavity and the outside of the terminal through the gap. The feeding part 12 feeds the conductive support 11 to excite the conductive support 11 to generate a current, a strong electric field is formed at the gap 115, and an electromagnetic wave signal is radiated through the gap 115. Specifically, the feeding part 12 and the conductive support 11 form a current loop, the current loop forms a magnetic pole. In a form of near-field coupling, the conductive support 11 becomes excited to generate a current opposite to the direction of the current loop. The current loop forms an inductor L, a strong electric field is formed at the gap 115, and a distributed capacitor is formed at the gap 115, that is, the gap 115 becomes equivalent of a capacitor C. The distributed capacitor C generated by the gap 115 and the inductor L of the current loop formed by the conductive support 11 are equivalent to an LC resonant cavity. When the LC resonant cavity is in a resonant mode, it radiates an electromagnetic wave signal to the outside of the mobile terminal. In other words, a strong electric field is generated at the gap 115, and the strong electric field at the gap 155 may radiate out an electromagnetic wave signal.

In the antenna 10 in this application, the cavity 110 enclosed by the conductive support 11 cooperates with the feeding part 12 to radiate electromagnetic waves. Position arrangement of the antenna 10 has a low requirement on a clearance space, so that the antenna 10 can be applied in a position, with a poor clearance condition, in the mobile terminal 100, and can be applied inside the mobile terminal that has no clearance requirement. A mobile phone is used as an example. The antenna 10 may be disposed in a middle position of the mobile phone (namely, a middle area between the top and the bottom corresponding to the short sides 102 of the mobile terminal 100 shown in FIG. 1), thereby expanding layout space of the antenna 10, and making antenna layout space in the mobile terminal 100 more flexible. In addition, for a mobile phone with a metal side frame, the antenna 10 provided in this application is disposed inside the side frame, without a need to dispose a gap on the metal side frame, so that structural strength of the side frame can be ensured, and good experience of a complete appearance surface can be provided to a user. In addition, for the mobile terminal, extension of the display of the mobile terminal to the side frame does not affect performance of the antenna. The antenna provided in this application may be used in an environment with a poor clearance condition, and performance of the antenna is not affected even if the display covers the side frame and a part of the back cover. Therefore, using the antenna 10 provided in this application helps implement trends of a narrower side frame and a larger screen of the mobile terminal 100.

As shown in FIG. 3A, in a specific implementation, the mobile terminal 100 includes a middle frame 107, the middle frame 107 is configured to mount the display 103, the second portion 112 is a part of the middle frame 107, and the cavity 110 is enclosed by the middle frame, the side frame, and the fourth portion 114. This implementation provides a mobile terminal of a front-mounted stacked architecture, where a display 103 is installed on a front side of a middle frame 107, and a circuit board 109 and a battery 106 are installed between the middle frame 107 and a back cover (the back cover is not shown in FIG. 3A, and an outer or inner side of the fourth portion 114 or a position of the fourth portion 114 is a specific position of the back cover). The first portion 111 and the middle frame 107 may be configured as an integrated structure, and the first portion 111 may be a battery retaining wall formed in the mobile terminal 100. With reference to FIG. 2 and FIG. 3A, the antenna 10 is formed in the space enclosed by the battery 106, the middle frame 107, the side frame 104, and the back cover 105. The side frame 104 includes a side frame at a long side of the mobile terminal and a side frame at a short side of the mobile terminal. In an implementation, the antenna provided in this application is distributed between the side frame at the long side and the battery.

In a specific implementation, the back cover 105 is made of a non-conductive material, for example, glass or plastic. As shown in FIG. 3A, the fourth portion 114 is a conductive layer disposed on an inner surface of the back cover 105. The fourth portion 114 is a conductive layer formed on the inner surface of the back cover 105 using a cold injection technique, a laser direct molding technique, or a print direct molding technique. The fourth portion 114 may alternatively be an FPC flexible board or a conductive film attached to the inner surface of the back cover 105.

Figure 4:
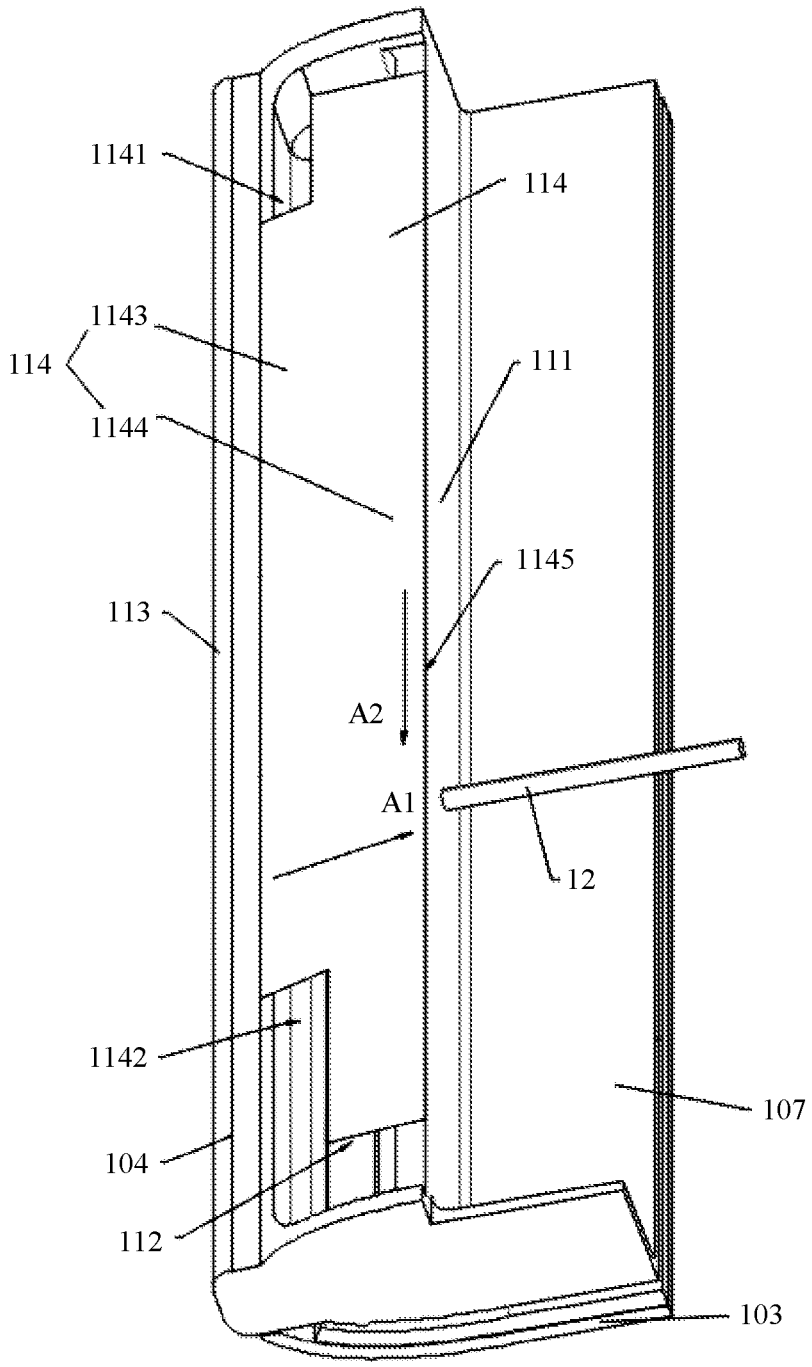
FIG. 4 is a schematic three-dimensional diagram of an antenna applied in a mobile terminal according to an implementation of this application.

In an embodiment in which the fourth portion 144 (a metal film, a conductive film, or an FPC) is attached to the inner surface of the back cover 105, a size and a shape of the fourth portion 144 may be adjusted according to a requirement, to adjust a resonance frequency of the antenna. As shown in FIG. 4, the back cover 105 is removed in FIG. 4, and the fourth portion 114 is directly exposed. Specifically, for example, when the fourth portion 114 is a metal film, local shearing may be performed on the fourth portion 114, to form a notch in the fourth portion 114, so as to adjust the size and the shape of the fourth portion 144. In a specific implementation, notches 1141 and 1142 are formed at a joint between the fourth portion 114 and the third portion 113, to lower the resonance frequency of the antenna. Positions at which the notches 1141 and 1142 are disposed may cut a current on the conductive support 11, and the current is forced to flow around a cut path, so that a length and a direction of the current on the conductive support 11 are changed, and a tuning function is achieved. The notch includes a first notch 1141 and a second notch 1142. The fourth portion 114 includes a connecting part 1143 connected to the third portion 113 and a main part 1144 away from the third portion 113. The first notch 1141 and the second notch 1142 are symmetrically distributed on two sides of the connecting part 1143, and in a case in which the first notch 1141 and the second notch 1142 are symmetrically distributed, both the first notch 1141 and the second notch 1142 have a same shape and size. Certainly, the first notch 1141 and the second notch 1142 may alternatively be structures with different shapes and/or sizes, and the sizes of the first notch 1141 and the second notch 1142 are separately set according to a specific tuning requirement.

Specifically, both the first notch 1141 and the second notch 1142 are rectangular, and the connecting part 1143 is formed between them, so that the fourth portion 114 is in a T-shaped structure. In this implementation, the first notch 1141 and the second notch 1142 are disposed, so that the fourth portion 114 is T-shaped, an operating frequency band of the antenna 10 can be achieved to reach a frequency range of N77+N79 (3.3 GHz to 5 GHz) by using a single antenna, and the efficiency of the antenna 10 reaches −5 dB or higher. In this implementation, the shape of the fourth portion is changed by disposing the notch, so that the resonance frequency of the antenna can be effectively lowered, and no loss is caused to antenna radiation efficiency and bandwidth.

In another implementation, only one notch may be used, and a position of the notch may be disposed at an edge position or a middle position of a joint between the fourth portion 114 and the third portion 113.

A gap 115 configured to radiate an electromagnetic wave is formed between the main part 1144 and the first portion 111, and the main part 1144 may be a rectangular, a trapezoid, or other irregular shape.

The direction from a joint between the connecting part 1143 and the third portion 113 to an edge (namely, a position, for forming the gap 115, of the main part), away from the connecting part 1143 of the main part 1144 and that extends perpendicular to a plane on which the fourth portion 144 is located is a first direction A1. An edge, away from the connecting part 1143 of the main part 1144 is a radiating edge 1145, and an extension direction of the radiating edge 1145 is a second direction A2. The second direction A2 may be perpendicular to the first direction A1. In the second direction A2, a size by which the gap 115 extends is a length of the gap 115, a vertical distance between the fourth portion 114 and the first portion 111 is a height of the gap 115, a size by which a vertical projection of the first portion 111 onto the plane on which the fourth portion 114 is located extends along the first direction is a width of the gap 115. Changes of a length, a height, and a width of the gap 115 can be used to adjust the resonance frequency of the antenna. The gap 115 forms loading of a distributed capacitor, the capacitance of which is proportional to the area of the gap 115, inversely proportional to the distance of the gap 115, and the resonance frequency is inversely proportional to the capacitance. Therefore, an increase in the projected area of the capacitor formed by the gap 115 results in an increase in the capacitance, thereby lowering the resonance frequency. The projected area has a length and a width. To be specific, the length and the width of the gap 115 are inversely proportional to the resonance frequency. An increase in the height of the gap 115 results in a decrease in the capacitance, thereby increasing the resonance frequency, that is, the height of the gap 115 is proportional to the resonance frequency.

Figure 5:
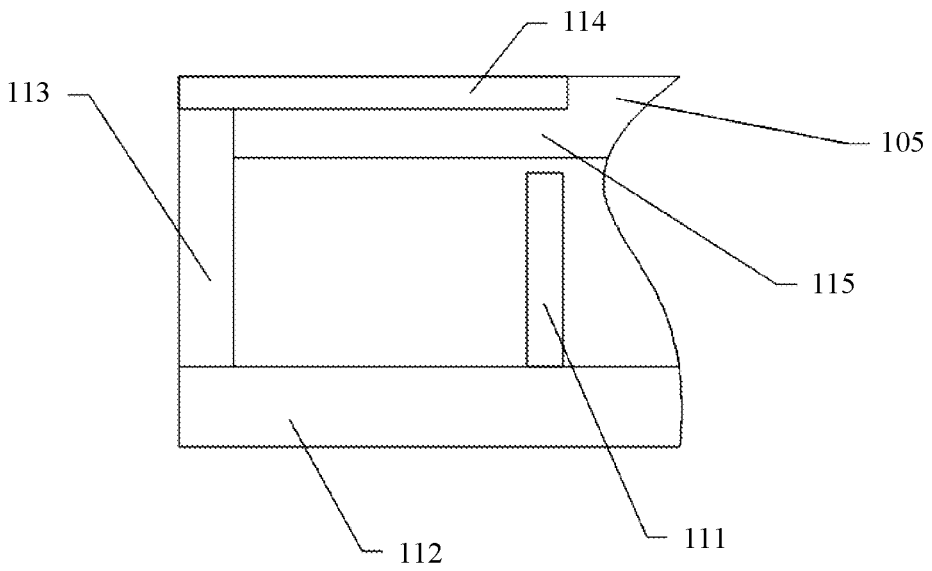
FIG. 5 is a schematic diagram of an antenna according to an implementation of this application, where only a structure of a conductive support is shown and a feeding part is not included.

As shown in FIG. 5, FIG. 5 schematically shows a position relationship between the first portion 111, the second portion 112, the third portion 113, and the fourth portion 114 of the conductive support 11. The back cover 105 and the display 103 show only an edge part. In a specific implementation, the back cover 105 is made of a non-conductive material, the fourth portion 114 is a functional layer attached to an outer surface of the back cover 105 (which is a surface, away from the display 103, of the back cover 105, and can be directly touched by a user). The functional layer may be a display used for display, a touch layer used for touching, or the like. For example, a bar-shaped display is disposed, as a functional layer, at an edge position that is near the side frame and that is on the outer surface of the back cover 105. The functional layer, the side frame, the middle frame, and the first portion 111 jointly form the resonant cavity (namely, the foregoing cavity 110) of the antenna. Certainly, the functional layer may alternatively be a touch layer, and an interface of the mobile terminal is controlled by a touch operation performed by a human hand on the touch layer. The touch layer may be configured as a touch key for volume adjustment, a touch surface for brightness adjustment, a touch key for starting or exiting a program, or the like.

To ensure that the outer surface of the back cover 105 forms a complete surface without an uneven structure and that a user has better experience, the functional layer (namely, the fourth portion) disposed on the outer surface of the back cover 105 and the outer surface of the back cover 105 may be coplanar, for example, may be coplanar on a plane or a curved surface. Specifically, a concave area may be provided on an edge of the outer surface of the back cover 105, the fourth portion 114 is mounted on the concave area, and the outer surface of the fourth portion 114 is coplanar with the outer surface of the back cover 105.

In another implementation, when the fourth portion 114 is a conductive layer disposed on the inner surface of the back cover, the fourth portion 114 may also be disposed as a functional layer for display or for touching, and a part of the back cover 105 covering an outer surface of the fourth portion 114 is a transparent protective layer.

Figure 6:
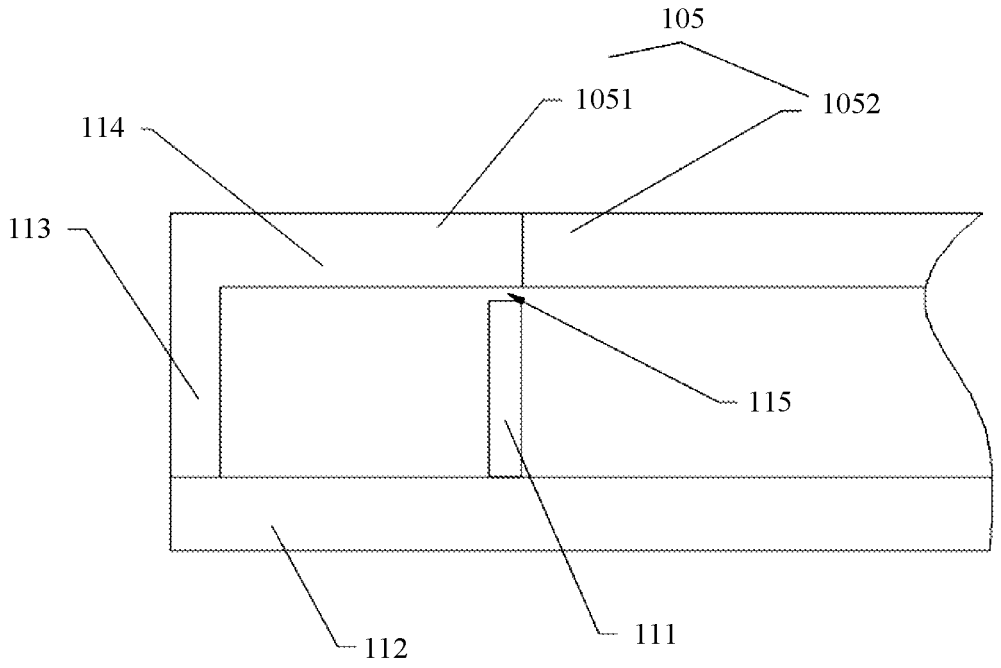
FIG. 6 is a schematic diagram of an antenna according to an implementation of this application, where only a structure of a conductive support is shown and a feeding part is not included.

The back cover in the foregoing two implementations is made of a non-conductive material. A conductive layer or a functional layer having a conductive function is disposed on the inner surface or the outer surface of the back cover, to implement arrangement of the fourth portion 114 of the conductive support 11. However, this application is not limited to the foregoing two implementations. In another implementation, as shown in FIG. 6, the back cover 105 includes a conductive area 1051 and a non-conductive area 1052 that are adjacent to each other, the fourth portion 114 is formed in the conductive area 1051, and the electromagnetic wave signal is radiated out through the non-conductive area 1052. In this implementation, the back cover 105 is formed in an integrated molding manner to form the conductive area 1051 and the non-conductive area 1052. The conductive area 1051 is disposed at an edge position of the back cover 105, and is disposed between the non-conductive area 1052 and the side frame (that is, at a position at which the third portion 113 is located).

Configurations of the feeding part 12 in this application include different embodiments in which the feeding part 12 is disposed in the cavity 110 and the feeding part 12 is disposed outside the cavity 110.

Figure 7:
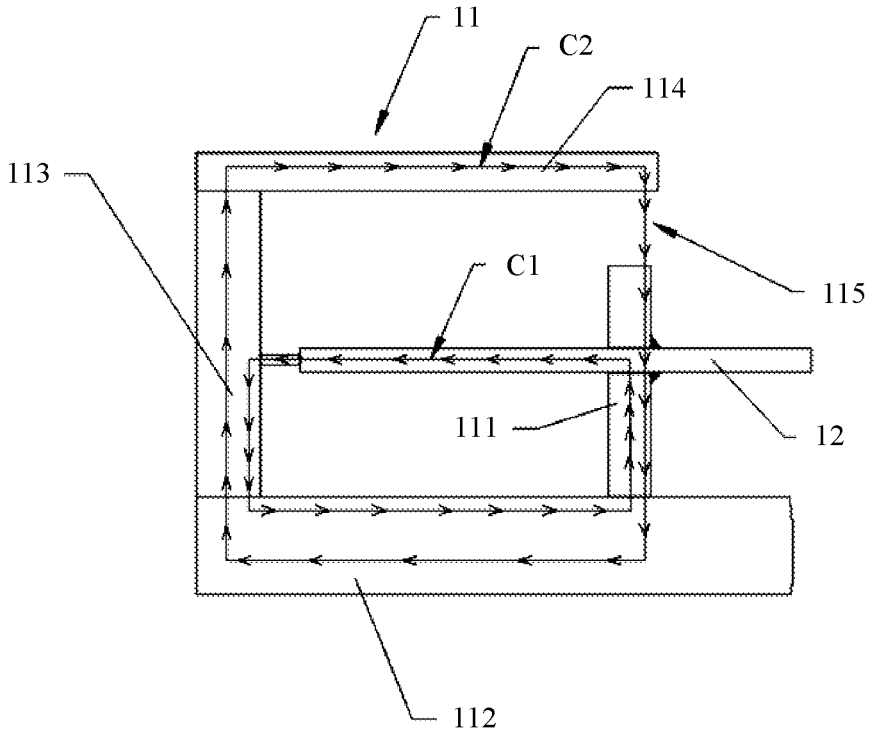
FIG. 7 is a schematic diagram of an antenna according to an implementation of this application.

In an implementation, as shown in FIG. 3A, FIG. 4, and FIG. 7, the feeding part 12 extends into the cavity 110, and the feeding part 12 in the cavity 110 and the conductive support 11 jointly form a current loop C1. The current loop C1 excites the conductive support 11 to generate a current opposite to the current direction of the current loop C1, which is referred to as a support current C2.

In a specific implementation, a through hole is disposed in the first portion 111 or the second portion 112. In an embodiment shown in FIG. 7, a through hole is disposed in the first portion 111 so that the feeding part 12 passes through the through hole, and in a similar manner, a through hole may alternatively be disposed in the second portion 112 so that the feeding part 12 passes through the through hole. The feeding part 12 passes through the through hole in the first portion 111 or the second portion 112 to extend into the cavity 110. The feeding part 12 is fixedly connected to the first portion 111 or the second portion 112. The feeding part 12 may be a coaxial line, and an outer conductor of the coaxial line and the second portion 112 may be fixedly connected by welding. As shown in FIG. 7, welding is performed at a joint between a surface, away from the cavity 110, of the first portion 111, and the feeding part 12. Certainly, the manner of fixing through welding may be replaced with fixing with other manners such as conductive adhesive bonding. An inner conductor of the coaxial line is electrically connected to the conductive support 11 to implement feeding.

Figure 8:
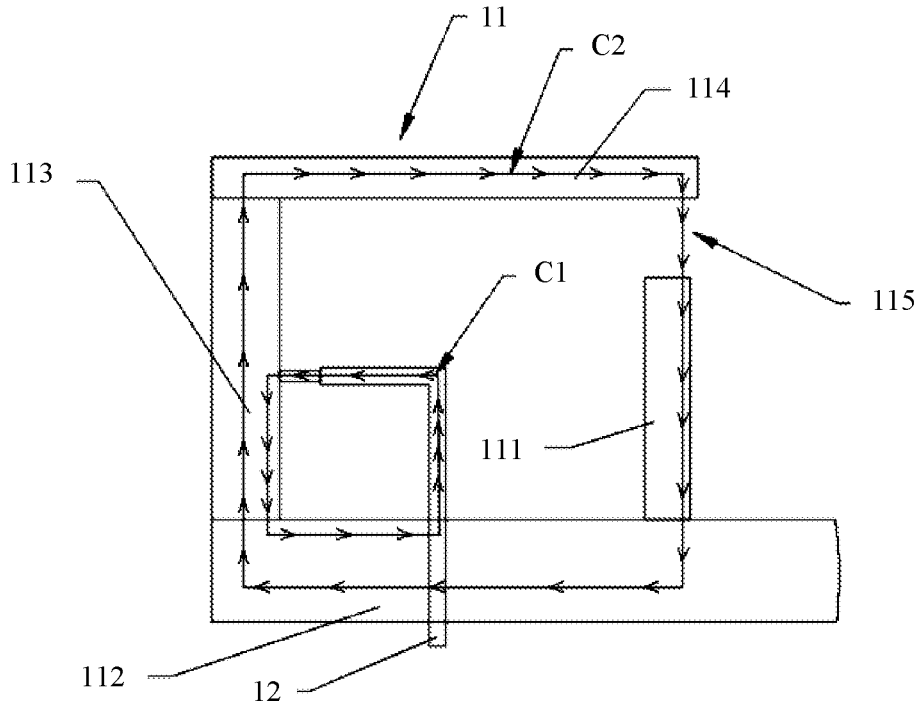
FIG. 8 is a schematic diagram of an antenna according to an implementation of this application.

As shown in FIG. 8, in an implementation, in the cavity 110, one end of the feeding part 12 is connected to the second portion 112, and the other end of the feeding part 12 is connected to the third portion 113, so that the feeding part 12, at least a part of the second portion 112, and at least a part of the third portion 113 jointly form the current loop C1. The feeding part 12 may be in a bent shape such as an L shape or a C shape.

Figure 9:
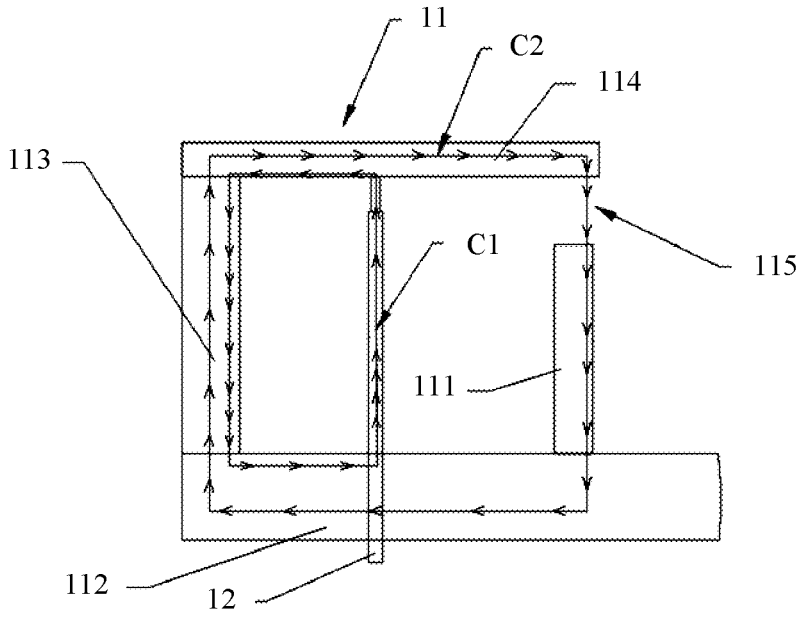
FIG. 9 is a schematic diagram of an antenna according to an implementation of this application.

As shown in FIG. 9, in another implementation, in the cavity 110, one end of the feeding part 12 is connected to the second portion 112, and the other end of the feeding part 12 is connected to the fourth portion 114, so that the feeding part 12, at least a part of the fourth portion 114, the third portion 113, and at least a part of the second portion 112 jointly form the current loop C1. The feeding part 12 may be in a shape of a straight line.

In another implementation, the feeding part 12 extends from the first portion 111 into the cavity 110, and the feeding part 12 extending into the cavity 110 may be electrically connected to any one of the second portion 112, the third portion 113, or the fourth portion 114, to form a current loop.

Figure 10:
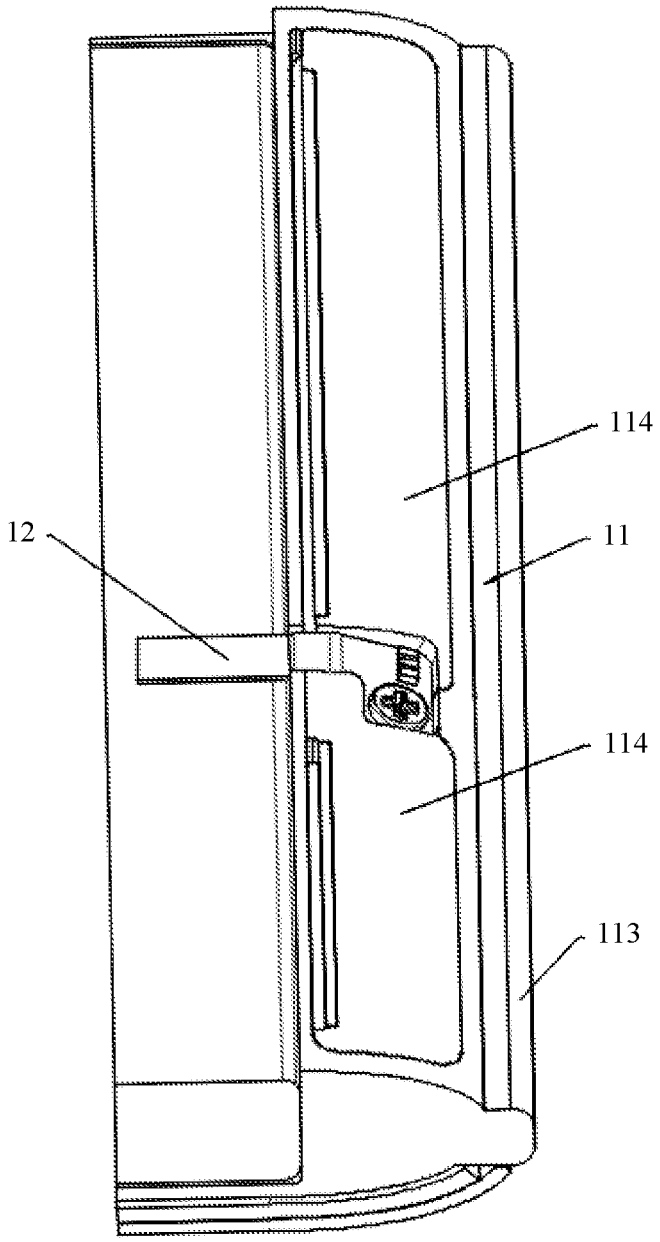
FIG. 10 is a schematic three-dimensional diagram of an antenna according to an implementation of this application, and mainly shows an embodiment of feeding outside a cavity.
Figure 11:
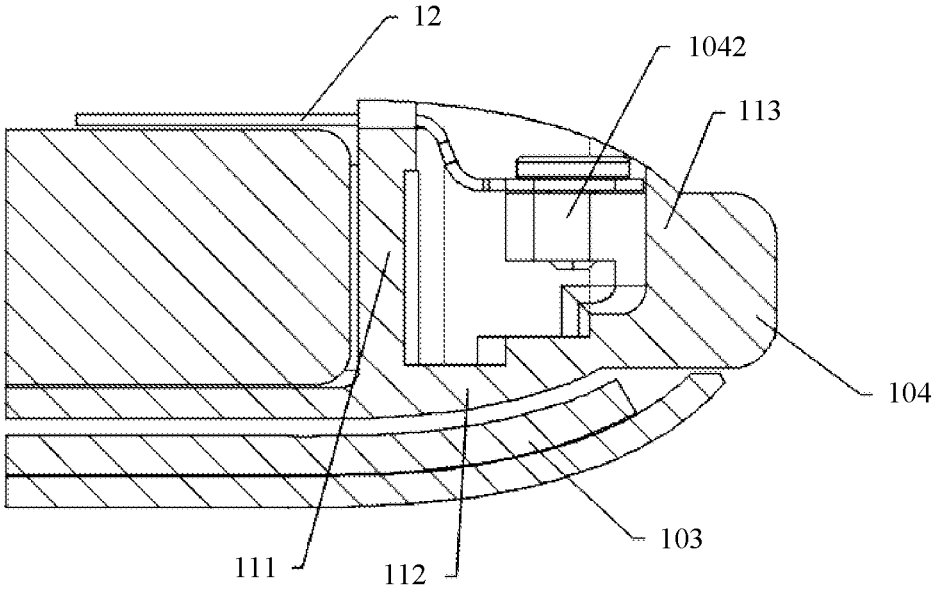
FIG. 11 is a schematic profile view of the antenna according to the implementation shown in FIG. 10.

As shown in FIG. 10 and FIG. 11, in an implementation, the feeding part 12 is located outside the cavity 110, and the feeding part 12 extends to an outer surface of the conductive support 11 and is fixedly connected to the side frame (namely, a location of the third portion 113) of the mobile terminal. The feeding part 12 may be disposed side by side with the fourth portion 114, that is, a vertical projection of the feeding part 12 onto a plane on which the fourth portion 114 is located is on a side of the first portion 111. The feeding part 12 may be adjacent to the fourth portion 114, or may be spaced apart from the fourth portion 114, that is, the vertical projection of the feeding part 12 onto the plane on which the fourth portion 114 is located does not overlap with the fourth portion 114. There may be an area of at least partial overlapping between the feeding part 12 and the fourth portion 114, where the feeding part 12 is located on a side that is of the fourth portion 114 and that faces the second portion 112, and at least a part of the feeding part 12 is covered by the fourth portion 114. The conductive support 11 is excited through the feeding of the feeding part 12 to form a current loop. This current loop can be considered as an unclosed annular current loop, and the gap 115 is equivalent to a capacitor structure. Because the fourth portion 114 and the feeding part 12 are arranged side by side, the fourth portion 114 is not shown in a cross-sectional position shown in FIG. 11.

Specifically, in an implementation, the feeding part 12 includes a flexible circuit board, a feeding circuit is disposed on the flexible circuit board, and the flexible circuit board is fixedly connected to the side frame 104, so that the feeding circuit is electrically connected to the conductive support 11. In another implementation, the feeding part 12 may alternatively be a coaxial line or another feeding form.

Specifically, an inner surface of the side frame 104 is connected to a fixed platform 1042, and the flexible circuit board (namely, the feeding part 12) is fixedly connected to the fixed platform 1042. In this implementation, the flexible circuit board is connected through screw fastening. In addition to the connection, grounding of the feeding part 12 may be further achieved.

As shown in FIG. 12, in an implementation, a mobile terminal 100 of a back-mounted stacked architecture is provided. The mobile terminal 100 includes a middle frame 107, and the middle frame 107 is located on an inner side of the back cover 105. Components such as a battery and a circuit board are installed between the middle frame 107 and a display 103, the back cover 105 covers the middle frame 107, and the middle frame 107 is usually made of a conductive material. The fourth portion 114 is a part of the middle frame 107, the cavity 110 is enclosed by the second portion 112, the side frame 104, and the middle frame 107, and the second portion 112 may be a display or a conductive sheet configured to fix the display. A through hole is disposed in the middle frame 107 to form the gap 115. In this implementation, the through hole is disposed in the middle frame 107 as the gap 115 used by the antenna to radiate an electromagnetic wave signal, and the back cover 105 is made of a non-conductive material. The fourth portion 114 of the conductive support 11 is an edge of the middle frame 107 and located between the first portion 111 and the side frame 104. A disposed position of the gap 115 may be a middle area of the fourth portion 114, or may be a position adjacent to the fourth portion 114 and the first portion 111, or may be a position adjacent to the fourth portion 114 and the third portion 113 (a position of the third portion 113 is a position of the side frame 104), provided that it can be ensured that an electromagnetic wave can pass between the cavity 110 and the outside of the mobile terminal through the gap 115. The first portion 111 may be a plate-like structure integrated with the middle frame 107, for example, a metal wall, or may be a conductive layer structure attached to a side wall of the battery, for example, a metal film.

In an implementation, the cavity 110 is filled with a medium to adjust a frequency of the antenna. The medium may be plastic of a PC material or an injection molding material used for nano-injection molding. A higher permittivity of the medium indicates a lower resonance frequency of the antenna. Certainly, the medium may alternatively be air. A permittivity range of the medium may be 1 to 4.

Figure 13:
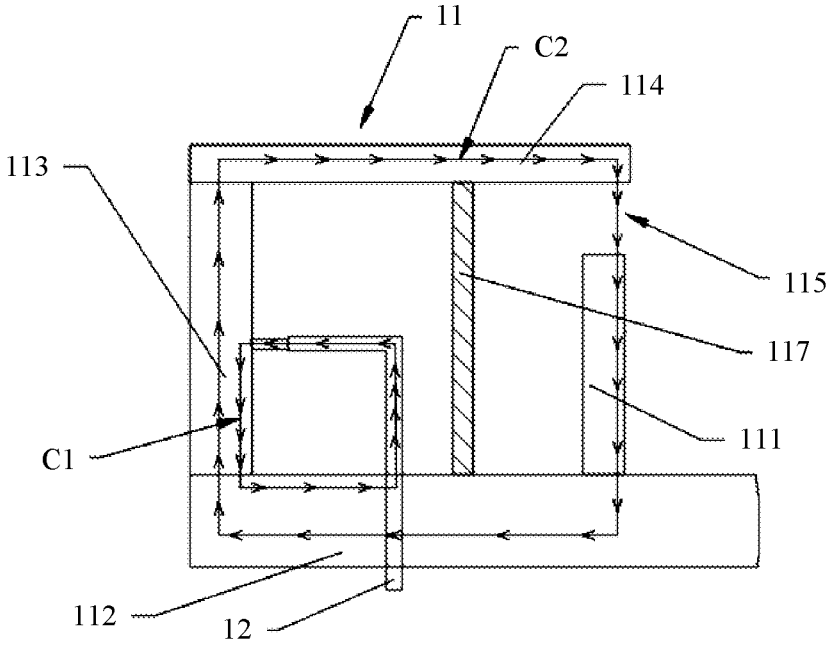
FIG. 13 is a schematic diagram of an antenna according to an implementation of this application.

As shown in FIG. 13, in an implementation, the antenna further includes a conductive member 117, the conductive member 117 is disposed in the cavity 110 and is electrically connected between the second portion 112 and the fourth portion 114, and the conductive member 117 forms an inductor path in the cavity 110, to adjust the resonance frequency of the antenna. The conductive member 117 may be a metal sheet or metal pillar structure integrated with the second portion 112 or the fourth portion 114.

Figure 14:
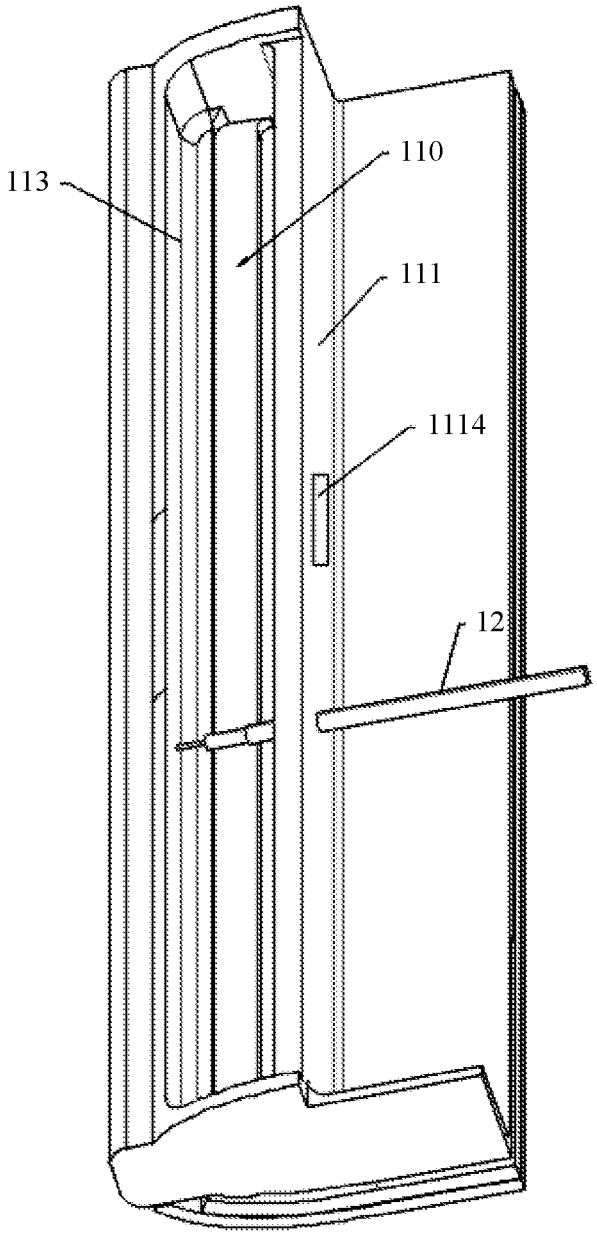
FIG. 14 is a schematic partial three-dimensional diagram of an antenna according to an implementation of this application.

As shown in FIG. 14, in an implementation, the conductive support 11 is provided with a slot 1114, the slot 1114 is disposed in the first portion 111 or the second portion 112, and is disposed in a location corresponding to a central area of the cavity 110. The slot 1114 is configured to adjust the resonance frequency of the antenna.

Figure 15:
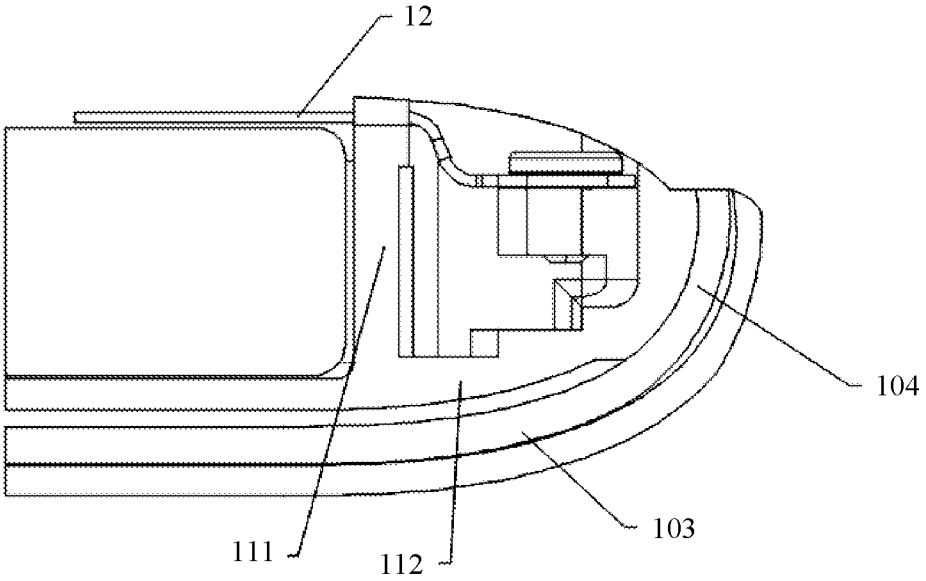
FIG. 15 is a schematic diagram of an antenna according to an implementation of this application.

As shown in FIG. 15, in an implementation, the side frame 104 includes a display part, the display part is a part of a display area of the display 103, the part of the display area extends to a position of the side frame 104, and the third portion 113 is a part of the display part. This implementation is applicable to a curved-screen mobile terminal, and the position of the side frame 104 is a curved part of the display 103.

Figure 16:
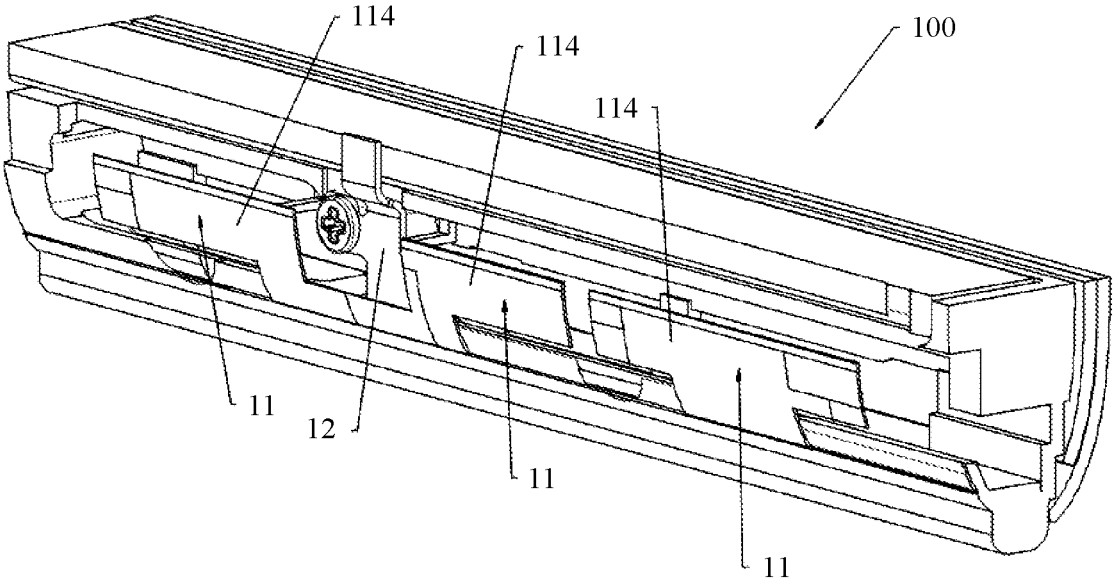
FIG. 16 is a schematic diagram of an antenna applied in a mobile terminal according to an implementation of this application, and shows an embodiment in which there are at least two conductive supports.

As shown in FIG. 16, in an implementation, there are two or more conductive supports 11, the conductive supports are distributed on a same side of the mobile terminal 100. There is one feeding part 12, and the one feeding part 12 simultaneously excites the two or more conductive supports 11. In this implementation, the feeding part 12 is located between the fourth portions 114 of the two adjacent conductive supports 11.

Two or more antennas may be disposed in the mobile terminal provided in this application, and the antennas are arranged in a middle area between a top side and a bottom side of the mobile terminal. A 5.2-inch mobile phone is used as an example. A length of an applicable area in the middle of the mobile phone is about 80 mm. For a 5G NR frequency band 3.3 GHz to 5 GHz, a single-side 80-mm space can accommodate two to three antennas, and a double-side 80-mm space can accommodate four to six antennas. Therefore, using the antenna provided in this application helps implement a 5G new band antenna in the mobile terminal. If further tuning is performed in the antenna solution, the antenna can be tuned to 1.7 GHz to 2.7 GHz and can be used as a 4G antenna or a Wi-Fi/Bluetooth antenna. The antenna can alternatively be tuned to 5 GHz or higher and used as a 5G Wi-Fi antenna. The antenna provided in this application is applicable to a relatively wide operating frequency band.

The antenna provided in the embodiments of this application is described in detail above. The principle and embodiments of this application are described herein through specific examples. The description about the embodiments of this application is merely provided to help understand the method and core ideas of this application. In addition, persons of ordinary skill in the art can make variations and modifications to this application in terms of the specific embodiments and application scopes according to the ideas of this application. Therefore, the content of specification shall not be construed as a limit to this application.

What is claimed is:

1. An antenna configured in a mobile terminal, wherein the mobile terminal comprises a display, a side frame, and a back cover, the side frame is connected between the display and the back cover, and the antenna comprises:

a conductive support comprising a first portion, a second portion, a third portion, and a fourth portion that are made of conductive materials and that jointly enclose a cavity, wherein the first portion and the third portion are disposed opposite to each other and are respectively connected to a head end and a tail end of the second portion; the fourth portion and the second portion are disposed opposite to each other; the second portion is disposed on an inner side of the display; the third portion is a part of the side frame; the fourth portion is located on an outer side of the back cover, or is located on an inner side of the back cover, or is a part of the back cover; the conductive support is configured with a gap; and the gap is formed between the fourth portion and the first portion, or is formed between the fourth portion and the third portion, or is disposed in the fourth portion; and a feeding part that is electrically connected to the conductive support and is configured to excite the conductive support to generate a current.

2. The antenna according to claim 1, wherein the feeding part is configured to feed an electromagnetic wave signal, and the antenna radiates the electromagnetic wave signal via the cavity and the gap in the conductive support.

3. The antenna according to claim 2, wherein the mobile terminal comprises a middle frame, the middle frame is configured to mount the display, the second portion is a part of the middle frame, and the cavity is enclosed by the middle frame, the side frame, and the fourth portion.

4. The antenna according to claim 3, wherein the back cover is made of a non-conductive material, and the fourth portion is a conductive layer disposed on an inner surface of the back cover.

5. The antenna according to claim 4, wherein a notch is formed at a joint between the fourth portion and the third portion.

6. The antenna according to claim 3, wherein the back cover is made of a non-conductive material, and the fourth portion is a functional layer attached to an outer surface of the back cover.

7. The antenna according to claim 3, wherein the back cover comprises a conductive area and a non-conductive area that are adjacent to each other, the fourth portion is formed in the conductive area, and the electromagnetic wave signal is radiated out through the non-conductive area.

8. The antenna according to claim 3, wherein the feeding part passes through the second portion to extend into the cavity, and the feeding part and the conductive support jointly form a current loop in the cavity.

9. The antenna according to claim 8, wherein one end of the feeding part is connected to the second portion, and the other end of the feeding part is connected to the third portion, so that the feeding part, at least a part of the second portion, and at least a part of the third portion jointly form the current loop.

10. The antenna according to claim 8, wherein one end of the feeding part is connected to the second portion, and the other end of the feeding part is connected to the fourth portion, so that the feeding part, at least a part of the fourth portion, the third portion, and at least a part of the second portion jointly form the current loop.

11. The antenna according to claim 3, wherein the feeding part is located outside the cavity, the feeding part is fixedly connected to the side frame of the mobile terminal, and the conductive support forms the current loop when feeding of the feeding part excites the conductive support.

12. The antenna according to claim 11, wherein the feeding part comprises a flexible circuit board, a feeding circuit is disposed on the flexible circuit board, and the flexible circuit board is fixedly connected to the side frame, so that the feeding circuit is electrically connected to the conductive support.

13. The antenna according to claim 12, wherein an inner surface of the side frame is connected to a fixed boss, and the flexible circuit board is fixedly connected to the fixed boss.

14. The antenna according to claim 2, wherein the mobile terminal comprises a middle frame, the middle frame is located on the inner side of the back cover, the fourth portion is a part of the middle frame, the cavity is enclosed by the second portion, the side frame, and the middle frame, and a through hole is disposed in the middle frame to form the gap.

15. The antenna according to claim 1, wherein the antenna further comprises a conductive member, and the conductive member is disposed in the cavity and is electrically connected between the second portion and the fourth portion.

16. The antenna according to claim 1 wherein the conductive support is configured with a slot, and the slot is disposed in the first portion or the second portion.

17. The antenna according to claim 1, wherein the side frame comprises a display part, the display part is a part of a display area of the display, the part of the display area extends to a position of the side frame, and the third portion is a part of the display part.

18. The antenna according to claim 1 wherein there are two or more conductive supports, the conductive supports are distributed on a same side of the mobile terminal, the feeding part simultaneously excites the two or more conductive supports.

19. A mobile terminal, comprising a display, a side frame, and a back cover, wherein the side frame is connected between the display and the back cover, a battery is disposed inside the mobile terminal, the mobile terminal further comprises an antenna located between the battery and the side frame, and the antenna comprises:

a conductive support, comprising a first portion, a second portion, a third portion, and a fourth portion that are made of conductive materials and that jointly enclose a cavity, wherein the first portion and the third portion are disposed opposite to each other and are respectively connected to a head end and a tail end of the second portion; the fourth portion and the second portion are disposed opposite to each other; the second portion is disposed on an inner side of the display; the third portion is a part of the side frame; the fourth portion is located on an outer side of the back cover, or is located on an inner side of the back cover, or is a part of the back cover; the conductive support is configured with a gap; and the gap is formed between the fourth portion and the first portion, or is formed between the fourth portion and the third portion, or is disposed in the fourth portion; and a feeding part that is electrically connected to the conductive support and is configured to excite the conductive support to generate a current.

20. The mobile terminal according to claim 19, wherein the mobile terminal comprises a pair of long sides and a pair of short sides, there are two or more of the antenna, the side frame comprises a long side segment at one of the long sides and a short side segment at one of the short sides, and the two or more antennas are distributed between the long side frame and the battery.

* * * * *